US011598108B2

(12) United States Patent
Laferriere

(10) Patent No.: US 11,598,108 B2
(45) Date of Patent: Mar. 7, 2023

(54) SUPPORT AND LEVELLING DEVICE

(71) Applicant: PGT GLOBAL INC., Stonewall (CA)

(72) Inventor: Rey Laferriere, Stonewall (CA)

(73) Assignee: PGT GLOBAL INC, Pinawa (CA)

( * ) Notice: Subject to any disclaimer, the term of this patent is extended or adjusted under 35 U.S.C. 154(b) by 0 days.

(21) Appl. No.: 17/151,125

(22) Filed: Jan. 16, 2021

(65) Prior Publication Data

US 2021/0285243 A1 Sep. 16, 2021

Related U.S. Application Data

(60) Provisional application No. 62/990,005, filed on Mar. 16, 2020.

(51) Int. Cl.
*E04B 1/38* (2006.01)
*E04G 21/18* (2006.01)
*E04B 1/41* (2006.01)

(52) U.S. Cl.
CPC ..... *E04G 21/1841* (2013.01); *E04B 1/40* (2013.01)

(58) Field of Classification Search
CPC ..... E04B 1/40; E04G 21/1841
USPC ..... 52/126.5
See application file for complete search history.

(56) References Cited

U.S. PATENT DOCUMENTS 5,333,423 A 8/1994 Propst
5,561,950 A 10/1996 Collins et al.
5,603,187 A * 2/1997 Merrin ..... F24S 25/61 52/90.2
5,666,774 A * 9/1997 Commins ..... E04H 12/2253 248/188.4
5,819,482 A * 10/1998 Belke ..... E04G 25/06 248/354.3
6,371,687 B1 4/2002 Heintz et al.
6,513,290 B2 * 2/2003 Leek ..... E04B 1/2604 52/297
6,983,570 B2 1/2006 Mead
7,296,386 B2 * 11/2007 Leek ..... E04H 12/2238 52/707
7,610,728 B1 * 11/2009 Manocchia ..... E04H 12/2253 52/298
D607,711 S * 1/2010 Adams ..... D8/354
8,156,701 B2 * 4/2012 Tsukada ..... E04F 15/0247 52/263
8,490,234 B2 7/2013 Rowell et al.
(Continued)

FOREIGN PATENT DOCUMENTS

GB 2070100 9/1981
JP 2018165459 10/2018
WO 2008072982 6/2008

*Primary Examiner* — Brian E Glessner
*Assistant Examiner* — James J Buckle, Jr.
(74) *Attorney, Agent, or Firm* — Paul Sharpe; The Sharpe Group

(57) ABSTRACT

A levelling structure for levelling a structure having supports for secondary support on fixed footings. A coupling mechanism extends between an access point on the structure and the footings. Adjustment of the coupling member from the structure alters the elevation of the structure and supports together towards or away from the footings. By providing the adjustment from the structure itself, the requirement for elevational adjustment beneath the structure is avoided as well as adjustment against the opposition of the load.

8 Claims, 6 Drawing Sheets

(56) References Cited

U.S. PATENT DOCUMENTS

| | | | | |
|---|---|---|---|---|
| 8,752,343 | B2 * | 6/2014 | Kuan | F24S 25/617 52/27 |
| 8,821,073 | B2 * | 9/2014 | Patton | E02D 35/005 52/741.15 |
| 8,925,263 | B2 * | 1/2015 | Haddock | H02S 20/23 52/173.3 |
| 8,938,918 | B2 * | 1/2015 | Ruland | E04F 15/02447 52/126.5 |
| 8,943,765 | B2 * | 2/2015 | Danning | F24S 25/20 52/173.3 |
| 9,010,041 | B2 * | 4/2015 | Danning | F24S 25/67 52/173.3 |
| 9,133,588 | B2 * | 9/2015 | Stroyer | E01D 19/02 |
| 9,188,273 | B2 * | 11/2015 | Merhar | F24S 25/10 |
| 9,366,052 | B1 * | 6/2016 | Warner | E04H 12/2253 |
| 9,499,992 | B2 | 11/2016 | Busby | |
| 9,732,521 | B2 * | 8/2017 | Babikian | E04B 2/7405 |
| 11,012,023 | B2 * | 5/2021 | Stearns | F24S 25/61 |
| 11,214,972 | B2 * | 1/2022 | Bayless | B66F 3/08 |
| 2004/0163334 | A1 | 8/2004 | Carlson | |
| 2019/0119876 | A1 | 4/2019 | Grussenmeyer et al. | |

* cited by examiner

SUPPORT AND LEVELLING DEVICE

FIELD OF THE INVENTION

The present invention relates to a support device and more particularly, the present invention relates to a support and levelling arrangement for supporting a structure and allowing for simplified use for levelling the structure relative to the surface upon which it is placed.

BACKGROUND OF THE INVENTION

There is a wide array of levelling and supporting devices promulgated in the prior art. In a simple form, levelling devices, such as those for a large appliance provide a threaded rod having a foot at the terminal end. In use, a user must rotate the foot or footing under the weight of the appliance to which it is attached. This is clearly difficult and to be simplified, the weight of the appliance must be mitigated by lifting the appliance and then subsequently rotating the footing. Depending on the surface on which the appliance is placed, this may require several attempts in order to achieve levelling.

Another embodiment of levelling/supporting arrangements is the screw jack. These are generally used in levelling, for example an outdoor deck. The jack is disposed between a footing and the supporting beam of the deck. The footing is generally a cement preform in contact with the ground. The levelling is achieved by rotating the threaded handles of the jack which urges the threaded support rod up against the beam. As will be appreciated, there is a significant load on the jack. In some instances, the user must crawl under the deck to either install or use such jacks. This presents a significant safety issue. The possibility of the jack device moving off centre of the significant load can result in the structure falling onto the user underneath.

Another form of levelling arrangement typically used for deck support is the U shaped threaded bracket fixed into a cement preform. The bracket receives a section of lumber therein which, in turn, is connected to the beam of the deck. This arrangement is particularly limited in that the significant load of the deck must be borne by the section of lumber. In order to operate this system, the adjustment requires rotation of a nut under the full load of the deck negatively affecting the stability of the structure. Further, the mechanical components are exposed to the elements and over the course of time the connection between the steel rod in the cement can become compromised. To an unsuspecting user, adjustment, in light of the forces involved, could result in mechanical failure leading to injury.

In respect of the patent and related published literature, Carlson, in United States Patent Publication No. US 2004/0163334, published Aug. 26, 2004, provides an adjustable beam of the variety noted above. A cement footing is provided with a nut which receives a threaded segment attached to a U shaped bracket. The latter receives a beam therein. Adjustment is achieved by rotation under the full load of the structure underneath the U shaped bracket.

A method and apparatus for adjusting a pier block is provided in U.S. Pat. No. 5,561,950, issued to Collins et al., Oct. 8, 1996. A threaded rod is fixed into a footing and includes a rotatable member thereon for adjusting the elevation of a bracket suited to retaining a support. The adjustment is done on the threaded member under load and under the bracket.

Busby, in U.S. Pat. No. 9,499,992, issued Nov. 22, 2016, provides a height adjustable flooring substrate support system. The arrangement incorporates a plurality of spacer, plates and supports which are rotationally movable to support a floor on the ground. Adjustment is made by rotation of selected members of the multiple component structure and then a flooring material is placed there over.

U.S. Pat. No. 6,371,687, issued Apr. 16, 2002, to Heintz et al. discloses a method and apparatus for levelling a manhole cover frame. A rim holder engages the rim of the rim of the frame. A threaded bolt is threaded in the holder and allows elevational adjustment to the correct road surface level.

Other levelling arrangements are depicted in U.S. Pat. No. 3,511,001, issued May 12, 1970, to Morgan Jr. The arrangement is resilient levelling means for floors.

The arrangement provides an underlayment with a threaded adjustment for altering the underlayment relative to a concrete floor. Once levelled, finished flooring is placed there over. Once the finished flooring is positioned, no further adjustment of the levelling is possible. In embodiments, the arrangement includes biasing devices to provide a degree of resiliency to the finished floor. Although a generally useful arrangement, re-levelling is only possible by removal of the finished flooring material.

In order to mitigate the safety, mechanical and ease of use issues, there is required a support/levelling arrangement which allows a user to adjust elevation/level of a supported structure at the point of the supported structure, not beneath it. Further there is a need for such an arrangement that does not fixedly secure load bearing members to a footing or require movement of the footing to assist of facilitate levelling.

Advantageously, the present invention ameliorates the issues noted to provide a safe, effective and simple to use arrangement having application in a number of support/levelling environments.

SUMMARY OF THE INVENTION

A further object of on embodiment of the present invention is to provide a levelling apparatus suitable for levelling a structure having a top surface, comprising: a retaining member suitable for retaining a support member, the support member having a top surface and a bottom surface, the support member for supporting the structure;

an adjustable coupling member operatively connected between the retaining member and the top surface of the structure in use and operable from the top surface of the structure allowing levelling of the structure relative to a surface upon which the support member is positioned.

The arrangement may be utilized for levelling any number of structures, such as flooring, decks, platforms, stages, budding structures such as domiciles, bridges as well as furniture, pool tables, appliances, inter alia.

Of particular convenience is the fact that adjustment is possible from the structure to be levelled itself. This eliminates the need for accessing the underside to the structure. This is very advantageous in a situation where one needs to adjust the level of a low deck. With the present invention, the user can simply actuate the coupling member from top of the deck.

In some embodiments, the building structure includes an opening in registration with the adjustable coupling member to facilitate access to the adjustable coupling member whereby the building structure may be selectively levelled.

Optionally, the access point may be positioned on the structure at another point which is equally convenient and still provides the benefit of adjustment completely away from the underside of the structure and load bearing members and/or footings.

In embodiments herein, operative connection between the adjustable coupling and the retaining member comprises a threaded nut fixedly secured to retaining member.

Working in concert with the retaining member is the adjustable coupling comprising an elongate threaded rod extending between a top surface and a bottom surface of said support.

In some embodiments, the elongate rod may extend through the support from the top surface to the bottom surface. In other embodiments, the arrangement may include rods on either side of the support member.

A further object of one embodiment of the present invention is to provide a kit for facilitating levelling of support beams supporting a deck structure having support footings and a top deck surface, comprising:

a retainer for retaining a respective support beam;

a coupling structure adjustably coupled to the retainer and configured to extend, in use, from the support footings to an access point on said top deck surface whereby adjustment of the coupling structure from the deck surface alters the height of the respective support beam relative support footings.

A still further object of one embodiment of the present invention is to provide a method for levelling a structure having a frame on a surface upon which the structure is positioned, comprising:

positioning an adjustable coupling member between an access point on the structure, the frame and the surface upon which the structure is positioned; and adjusting the adjustable coupling member from the access point on the structure to alter the elevation of the structure and the frame together relative to the surface upon which the structure is positioned.

In use, the surface upon which the structure is positioned is maintained in a fixed position by the rotational movement of the adjustable coupling member relative to said surface upon which the structure is positioned. Movement of the structure and frame together towards or away from the surface upon which the structure is positioned is effected upon adjustment of the adjustable coupling member.

Other significant advantages will become transparent from a review of the details defined herein after.

Having thus generally described the invention, reference will now be made to the accompanying drawings, illustrating preferred embodiments.

BRIEF DESCRIPTION OF THE DRAWINGS

Similar numerals used in the Figures denote similar elements.

DETAILED DESCRIPTION OF THE PREFERRED EMBODIMENTS

Figure 1:
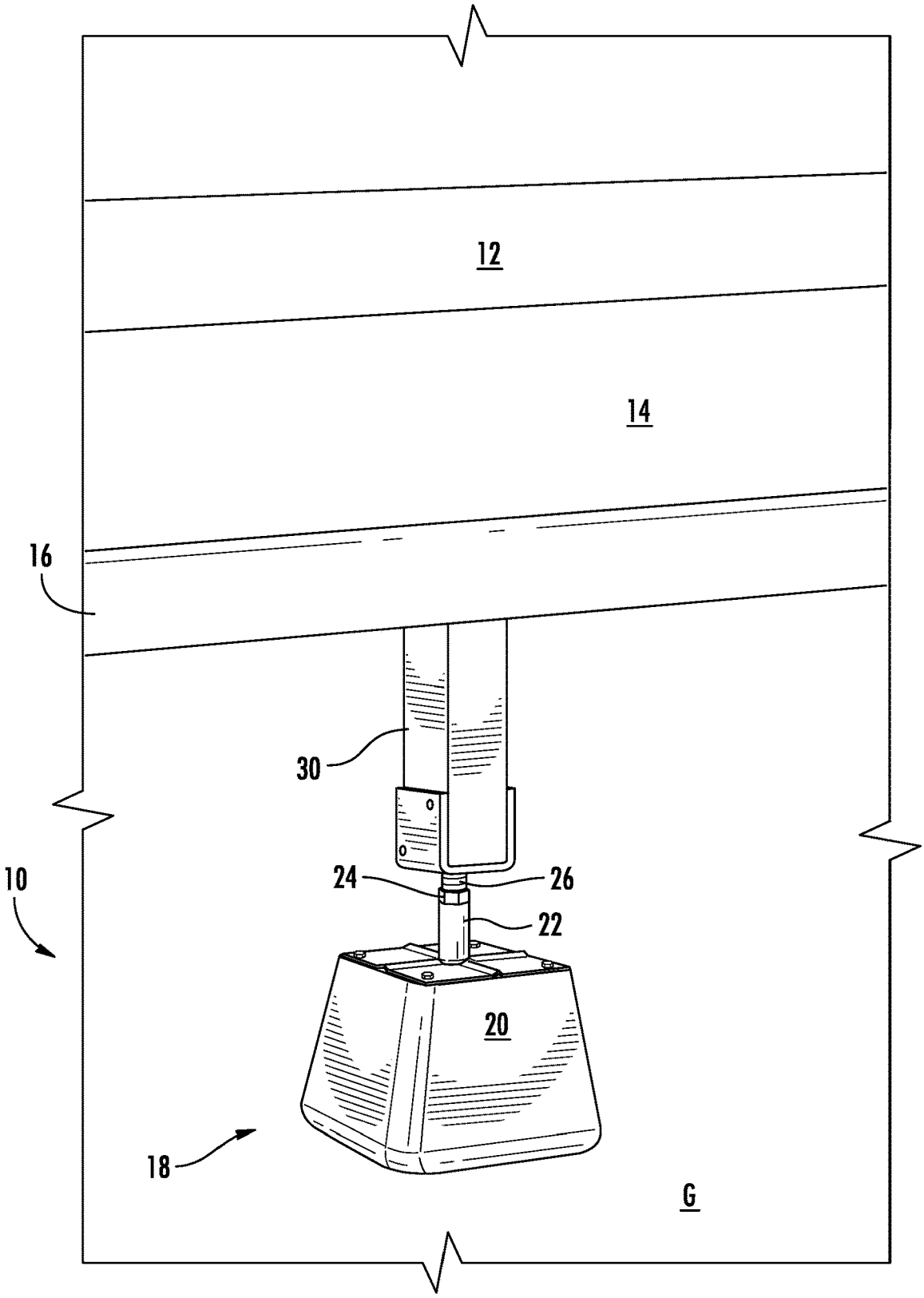
FIG. 1 (PRIOR ART)
FIG. 1 is a schematic illustration of a prior art arrangement.

Referring now to FIG. 1, shown is a prior art arrangement globally referenced by numeral 10 for supporting a structure 12, shown in the example as a deck platform 14. A support beam 16 underlies the platform 14.

For elevation and support, structure 18 is provided for positioning on the ground surface, G. The structure 18 provides a base or footing 20, typically a cement preform, into which is fixed a tube 22 having a threaded nut 24 connected thereto. Nut 24 threadably receives a threaded rod 26 having a U shaped bracket 28 connected thereto. The bracket 28 receives a section of lumber 30 therein; the lumber section 30 connects and supports support beam 16.

Adjustment of the beam 16 is achieved by turning nut 24 to urge the rod 26 upwardly. The adjustment of nut 24 must be done under the full load the arrangement is supporting.

Arrangements of this type are well known in the prior art and examples have been identified in the background herein.

From a support point of view, these arrangements are dangerous in that integrity is limited by the fixture of the tube 22 within the cement footing 20, quality of connection between the lumber section 30 with the bracket 28 and beam 16 and the physical ability of a user to adjust the nut 24 under significant load conditions. All of this is further exacerbated by the fact that adjustment requires a user to be directly adjacent all of the potential failure areas. This is a potentially injurious situation where a user must crawl under the structure 12 to perform a levelling adjustment.

Figure 2:
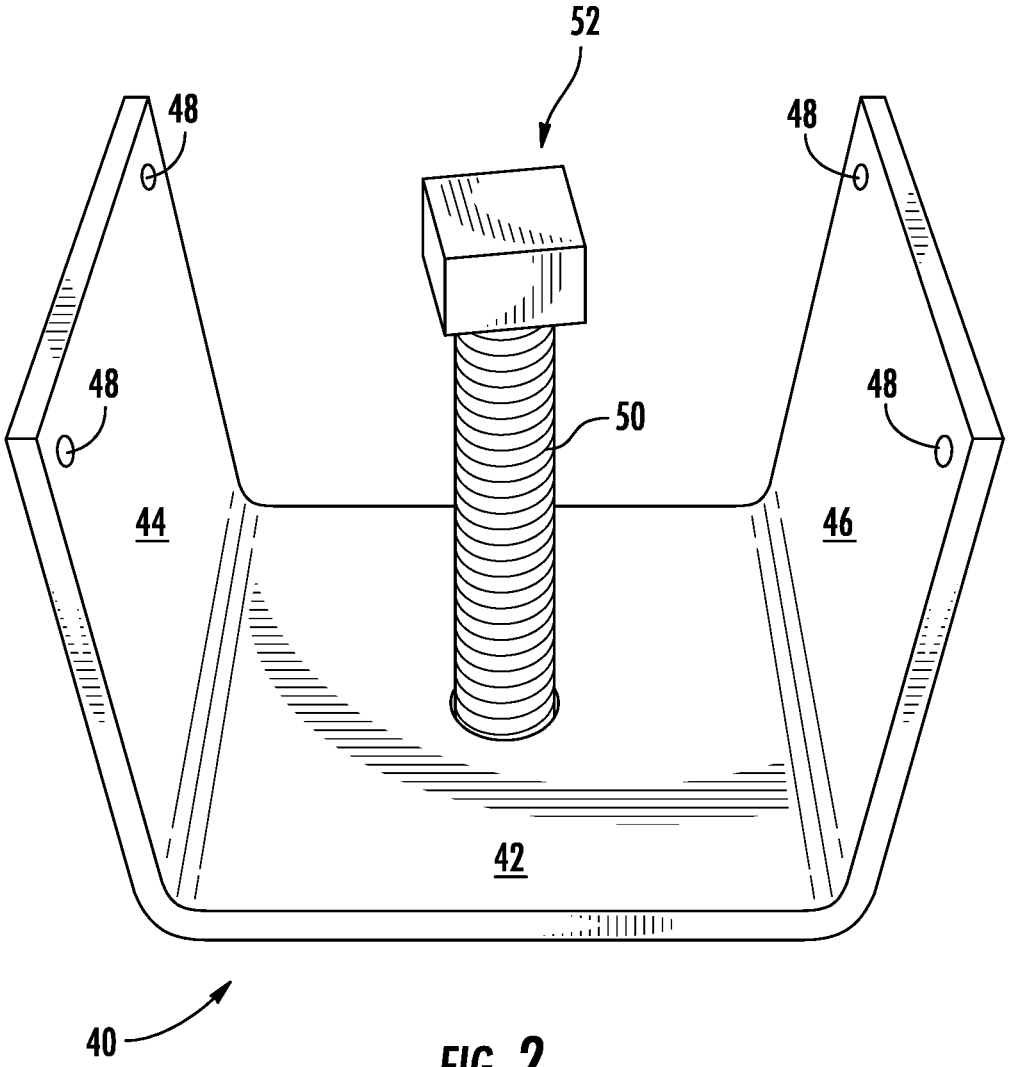
FIG. 2 is a perspective view of one embodiment of the present invention.
Figure 3:
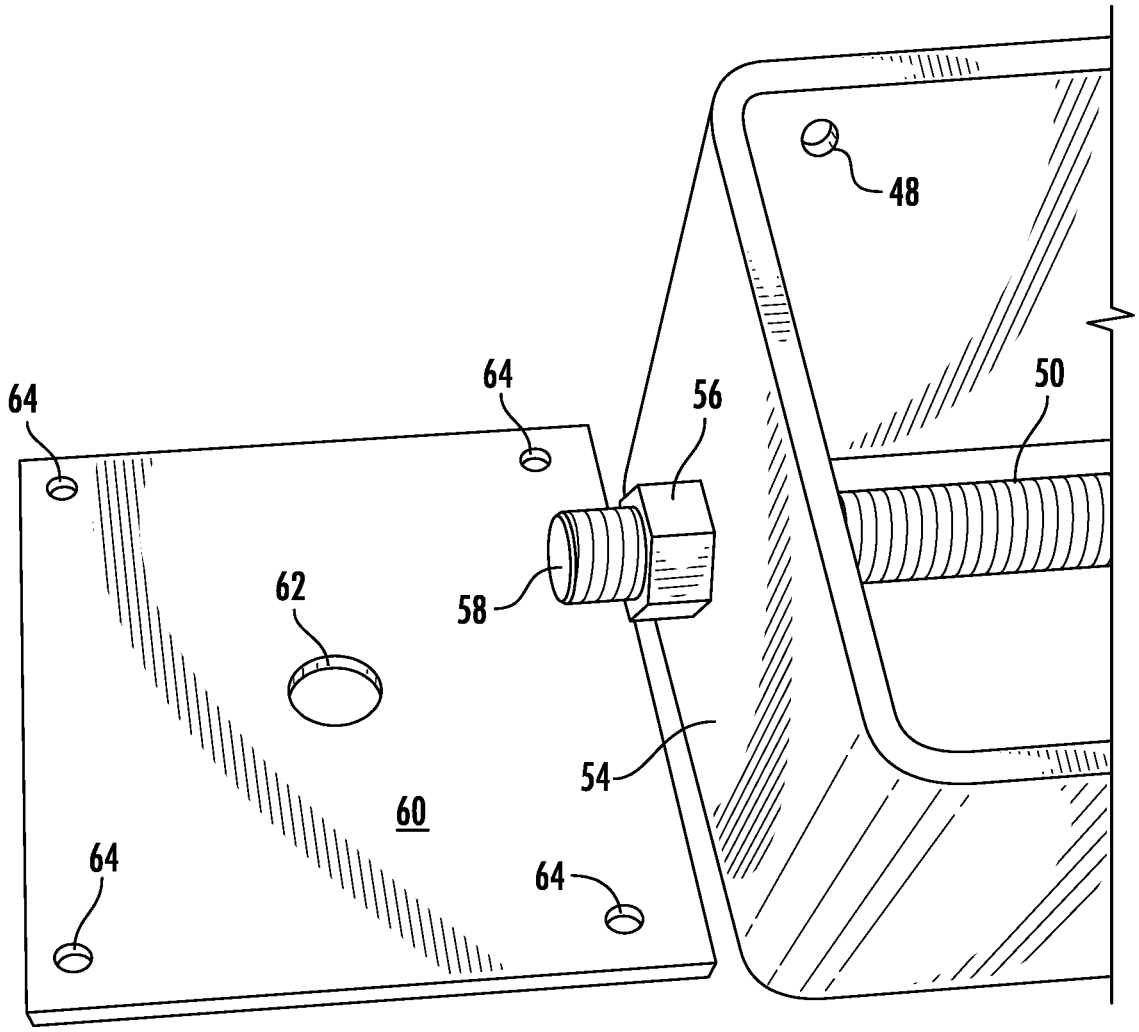
FIG. 3 is a bottom isolated view of the embodiment of FIG. 2.

FIGS. 2 and 3 illustrate a first embodiment of the invention which overcomes the limitations of the existing arrangements in the prior art. In the example, a retaining member 40 is provided for retaining a support (not shown) discussed herein after with respect to the advancing Figures. Retaining member 40, in this example, comprises a unitary body having a base 42 and spaced apart walls 44 and 46 integral therewith. Each of the walls 44 and 46 include apertures 48 for receiving fasteners (not shown).

Disposed centrally through base 42 is a threaded rod 50 extending upwardly through the base 42 in a spaced apart relation with walls 46 and 48. The threaded rod 50 terminates at a free end with a nut 52.

The underside 54 of base 42 (shown in FIG. 3) provides a nut 56 which is fixedly secured to underside 54. Threaded rod 50 is received within nut 56. The opposed end of the threaded rod 50 includes a non threaded segment 58. In use, discussed in the advancing Figures, a push off plate 60 having an aperture 62 receives segment 58. Apertures 64 are also provided to receive fasteners (not shown).

Figure 4:
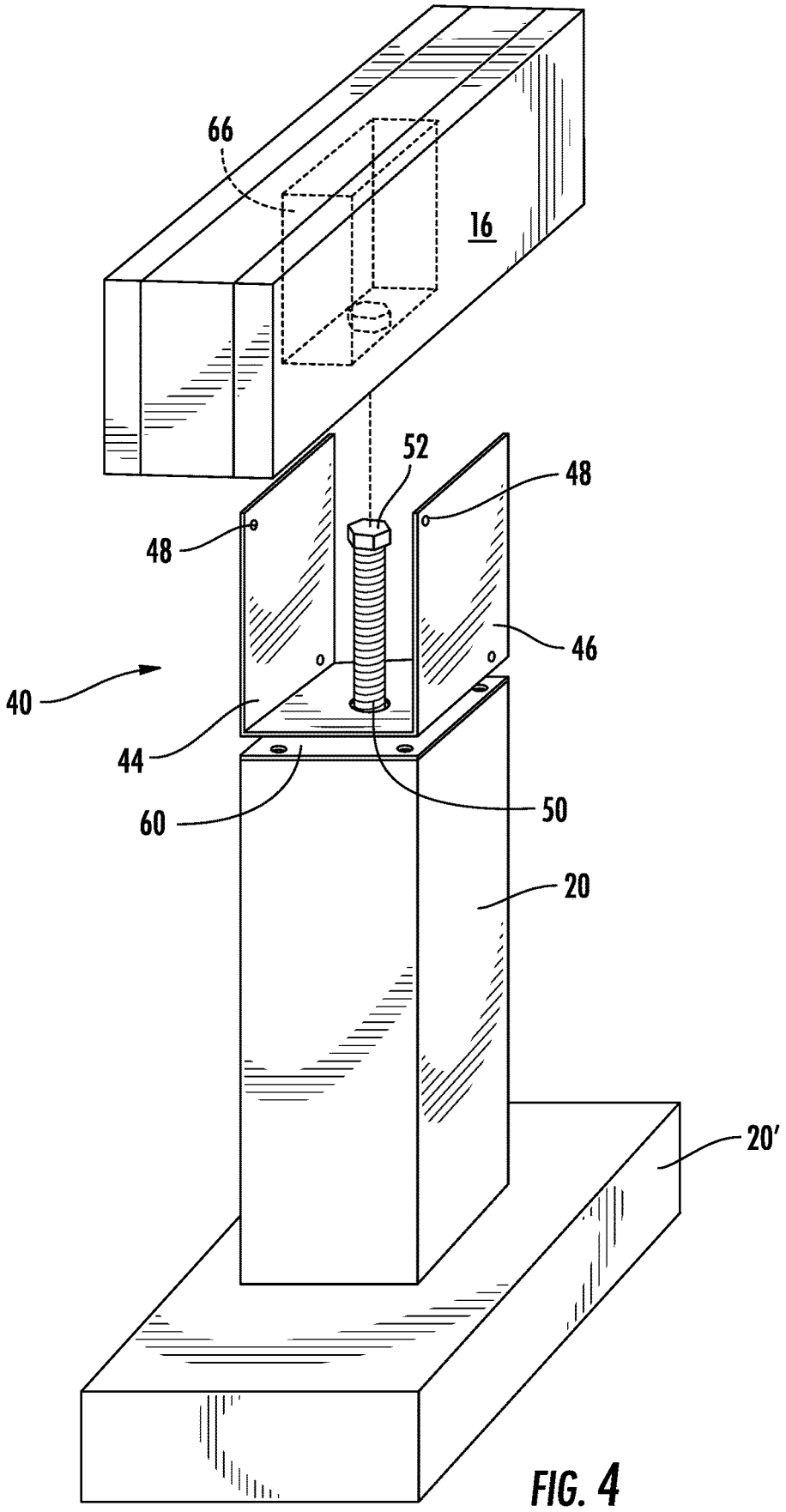
FIG. 4 is a schematic illustration of the arrangement of FIGS. 2 and 3 in a use position.
Figure 5:
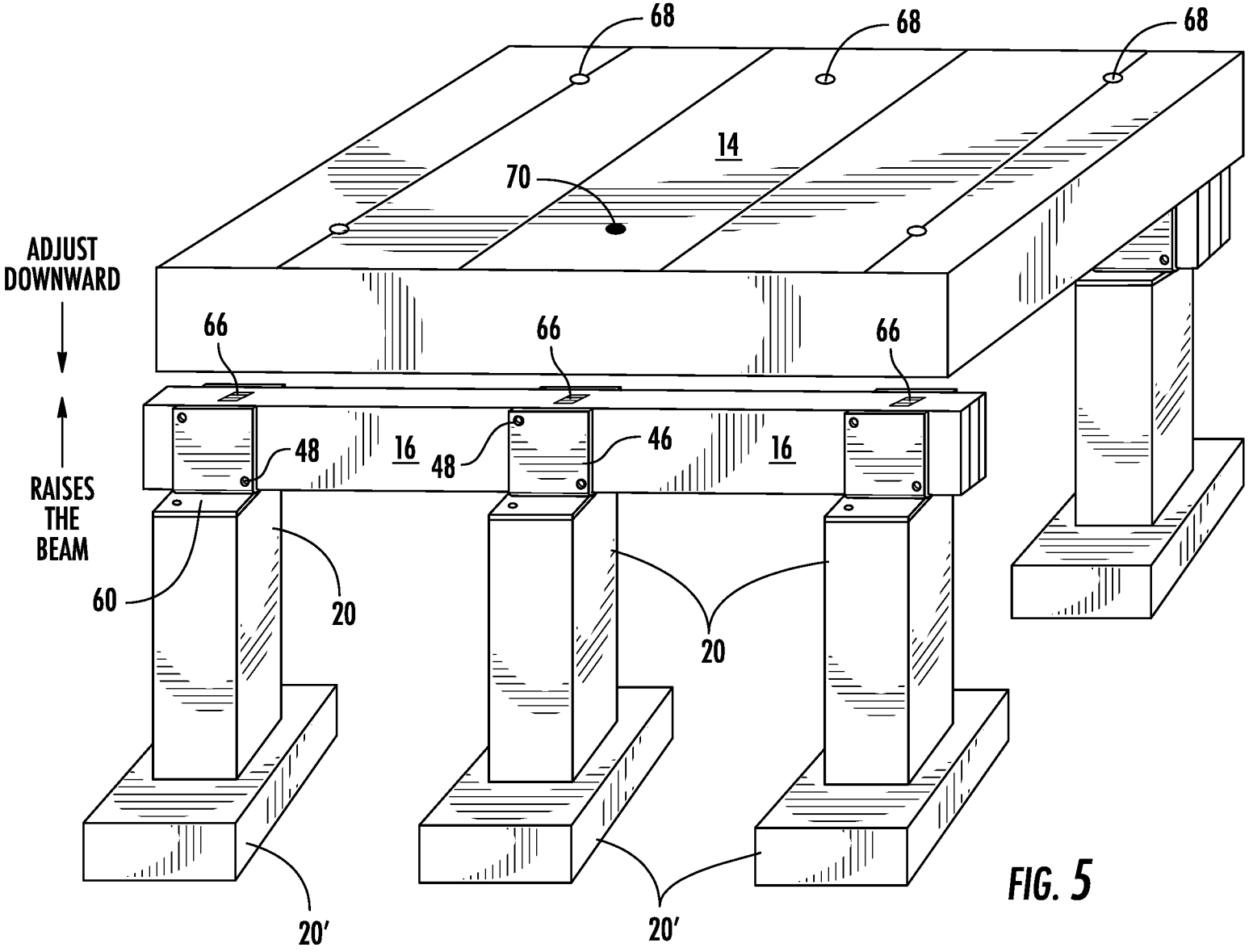
FIG. 5 is a schematic illustration of the implementation of the device with a building structure.

Turning now to FIGS. 4 and 5, shown is an example of the arrangement in use. A footing arrangement comprising 20 and 20' is provided. The top of footing 20 includes the push off plate 60 fastened to the footing 20 via the apertures 64. Segment 58 seats in aperture 62 as referenced in FIG. 3.

A beam structure 16 is retained within the retaining member 40 and fastened thereto via apertures 48. Beam structure 16 includes a passage 66 therethrough to receive threaded rod 50. Rod 50 is rotatable within passage 66 and may extend partially above the top of the beam structure 16.

As will be evident from FIGS. 4 and 5, the beam structure 16 normally rests on the support 20 and in particular, push off plate 60, when included. The plate 60 may not be necessary in ail scenarios and will depend on the type of material used for the footing 20. In the example, the structure 14 being supported is a deck platform which will be referenced with numeral 14 for purposes of explanation only. The structure 14 overlies beams 16 and includes access points 68 extending therethrough which register with the passages 66 in the beams 16. In this manner, access to the nut 52 of rod 50 is accessible for rotation from the top of the structure 14. There is full access for a user (not shown) to rotate the nut with a suitable device from the top surface of the structure 14 without having to access the arrangement anywhere under the structure 14, beams 16 or footings 20. Conveniently, the nut 52 may be adjusted using, for example, a socket driver. Sealing members 70 may be used to temporarily seal the access points 68.

As is schematically illustrated in FIG. 5 and with further reference to FIG. 4, rotation of the nut 52 from the top surface of the structure 14 alters the elevation of the beam structure 16 relative to the footing 20 by pushing away from the footing from atop the structure 14. With the provision of the push off plate 60 and the seating arrangement of segment 58 in aperture 62, an efficient arrangement is realized. The coupling arrangement, i.e., the retaining member 40, rod 50 and nut 56 is particularly well suited to accommodating significant loads. For example, for the threaded rod of a diameter of ⅞", the load capability is in excess of 7000 kg. With the provision of the load being pushed down from the top, a mechanical advantage is provided.

This makes adjustment from the top nearly effortless as is evinced by the fact that a simple socket driver can be used to adjust the level of a significant load.

With the provision of multiple arrangements over the structure 14, the levelling can be done at a plurality of points to effectively fine tune the levelling of the structure 14.

Figure 6:
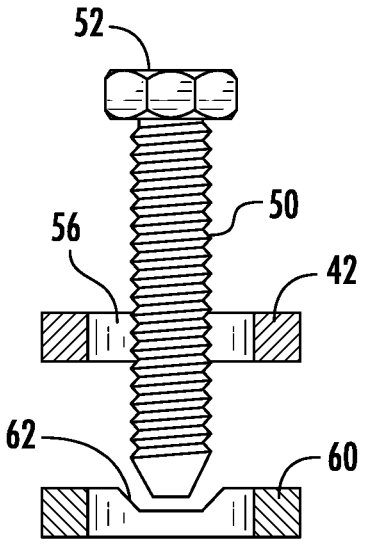
FIG. 6 is a cross section of an alternate embodiment of the present invention.

As will be appreciated, the arrangement can be employed in a number of different embodiments and can be used for levelling building structures, furniture, appliances among a host of other objects. To this end, FIG. 6 illustrates a further embodiment. In this arrangement, the retaining member 40 may include only the base 42 having the nut 56 similar to FIG. 2. This is useful for adjusting the elevation of lighter loads, where the retaining base 42 retains the structure (not shown) to be supported.

Figure 7:
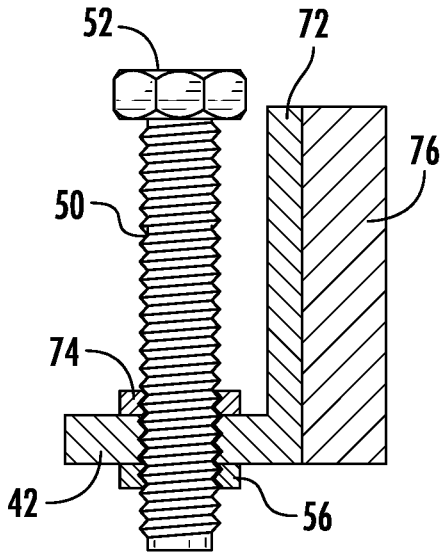
FIG. 7 is a cross section of an alternate embodiment of the present invention.

FIG. 7 illustrates an alternative embodiment where base 42 includes a single wall support 72 extending there from. In this embodiment, a second nut 74 may be fixedly secured to the topside of the base 42 to cooperate with nut 56 for enhanced strength. In this example, wall 72 may be secured to a surface to be supported and levelled (not shown) or may be integrated into the body of, for example, an appliance, generally represented by numeral 76. In the case of an appliance being supported, adjustment can be done in an isolated manner from the underside. As is known, adjustment for existing appliance arrangements involves rotation of the footing which is under load conditions and thus moves the load upwardly to achieve levelling. In the embodiment of FIG. 7, adjustment is achieved by pushing down on the load from an area completely spaced from the footing.

Figure 8:
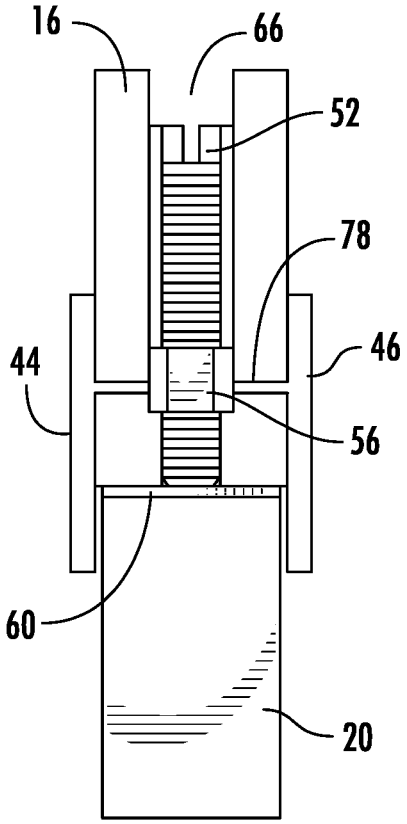
FIG. 8 is a perspective view of an alternate embodiment of the present invention.

FIG. 8 illustrates yet another embodiment. In this example, walls 44 and 46 extend to receive the beam 16 and at least a part of the footing 20. A cross brace 78 extends between walls 44 and 46 and mounts nut 56 centrally there between. This arrangement adds additional lateral reinforcement by coupling the retaining member to a greater extent between the footing 20 and beam 16.

Figure 9:
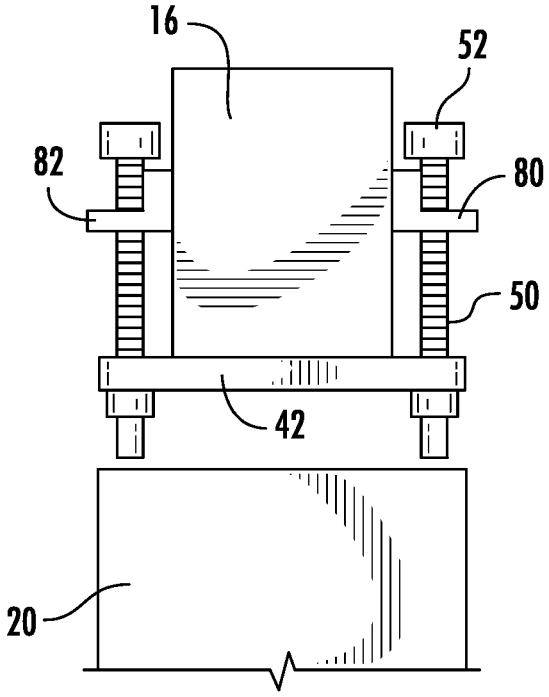
FIG. 9 is a cross section of an alternate embodiment of the present invention.

FIG. 9 illustrates yet another embodiment of the arrangement. In this example, the coupling member is relocated from generally within the beam 16 and between walls 44 and 46, to a location outside of the beam 16 and more particularly at the sides thereof. In this arrangement retaining members 80 and 82 are fixedly secured to each side of the beam 16 and are each thread ably received within a respective threaded rod 50. Each rod 50 passes through retaining member 42. As with the previous embodiments, adjustment of the nut 52, pushes the beam 16 away from the footing 20 and in this example, away from the retaining member 42.

As has been set forth, the embodiments allow for the alteration of the elevation of a supported structure by incorporating a coupling structure which may be disposed generally within a supporting structure or alongside of same. Such arrangements allow for adjustment from the top and directly adjacent the top of a structure being supported to allow for the significantly reduced effort in adjusting a load and while allowing this to be performed using the load for a mechanical advantage out of a potentially dangerous situation attributed to making adjustments under the load.

I claim:

1. A levelling apparatus for levelling a structure having a top surface with a plurality of openings accessible from said top surface, comprising:

a retaining member comprising a plate having a topside and underside, said topside having a beam retaining surface for retaining a beam arrangement, said retaining member having a threaded nut fixedly secured to said underside thereof free of said beam arrangement and said beam retaining surface, said beam arrangement having a top surface and a bottom surface, said beam arrangement for supporting said structure, said beam arrangement having a passageway therethrough extending from said top surface to said bottom surface, said structure resting upon said beam arrangement;

an adjustable threaded coupling member having a first end and a second end spaced therefrom, said second end comprising a free end with a nonthreaded segment adapted for contact with a surface on which it rests, said threaded coupling member connected between said threaded nut of said retaining member through said passageway of said beam arrangement to an opening of said openings in said top surface of said structure and operable from said top surface of said structure at said first end of said threaded coupling Member for adjusting the elevation of said beam arrangement by movement of said retaining member on said threaded member relative to said surface upon which said nonthreaded second end is in contact absent vertical movement of said threaded coupling member.

2. The apparatus as set forth in claim 1, wherein said apparatus further includes a supplemental support for positioning between said free end of said adjustable threaded coupling member and said surface.

3. The apparatus as set forth in claim 2, wherein said supplemental support comprises a plate having a seating for seating said free end.

4. The apparatus as set forth in claim 1, wherein said retaining member is fixedly secured to said beam arrangement.

5. The apparatus as set forth in claim 1, wherein said structure comprises a platform.

6. The apparatus as set forth in claim 1, wherein said structure comprises a building.

7. A method for levelling a deck platform having a top surface with a plurality of apertures through said top surface, comprising:

providing a beam arrangement upon which said deck platform rests, said beam arrangement having a top surface and a bottom surface, said beam arrangement for supporting said platform, said beam arrangement having a passageway therethrough extending from said top surface to said bottom surface;

providing a retaining member comprising a plate having a topside and underside, said topside having a beam retaining surface for retaining said beam arrangement, said retaining member having a threaded nut fixedly secured to said underside thereof free of said beam arrangement and said beam retaining surface;

providing an adjustable threaded coupling member having a first end and a second end spaced therefrom, said second end comprising a free end with a nonthreaded segment adapted for contact with a surface on which it rests, said threaded coupling member connected between said threaded nut of said retaining member through said passageway of said beam arrangement to an opening of said openings in said top surface of said platform and operable from said top surface of said platform at said first end of said threaded coupling member for adjusting the elevation of said beam arrangement by movement of said retaining member on said threaded member relative to said surface upon which said nonthreaded second end is in contact absent vertical movement of said threaded coupling member;

adjusting said adjustable threaded coupling member from said top surface of said platform through rotation of said rotatable coupling member to adjust the elevation of said beam arrangement by movement of said retaining member on said threaded coupling member relative to said surface upon which said free end of said adjustable threaded coupling member is positioned.

8. The method as set forth in claim 7, further including the step of providing a supplemental support as a surface upon which said free end of said adjustable threaded coupling member is seated.

* * * * *